US008966693B2

(12) United States Patent
Tucker et al.

(10) Patent No.: US 8,966,693 B2
(45) Date of Patent: Mar. 3, 2015

(54) METHOD AND APPARATUS FOR EXTENDED USE OF CLEANING FLUID IN A FLOOR CLEANING MACHINE

(75) Inventors: Steven W. Tucker, Centennial, CO (US); Daniel C. Venard, Centennial, CO (US)

(73) Assignee: Karcher N. America, Inc., Englewood, CO (US)

( * ) Notice: Subject to any disclaimer, the term of this patent is extended or adjusted under 35 U.S.C. 154(b) by 436 days.

(21) Appl. No.: 12/845,569

(22) Filed: Jul. 28, 2010

(65) Prior Publication Data

US 2011/0030163 A1 Feb. 10, 2011

Related U.S. Application Data

(60) Provisional application No. 61/231,504, filed on Aug. 5, 2009.

(51) Int. Cl.
*A47L 11/30* (2006.01)
*A47L 11/40* (2006.01)

(52) U.S. Cl.
CPC ..... *A47L 11/305* (2013.01); *A47L 11/4044* (2013.01)
USPC ..... 15/4

(58) Field of Classification Search
USPC ..... 15/320, 401, 340.1–340.4
See application file for complete search history.

(56) References Cited

U.S. PATENT DOCUMENTS

| | | | |
|---|---|---|---|
| 982,570 | A | 1/1911 | Brooks |
| 1,069,608 | A | 8/1913 | Ewing et al. |
| 1,695,246 | A | 8/1913 | Gammeter |
| 1,107,564 | A | 8/1914 | Ward |
| 1,176,408 | A | 3/1916 | Skrzyszewski |
| 1,211,902 | A | 1/1917 | Warner |
| 1,241,114 | A | 9/1917 | Hedley et al. |
| 1,268,571 | A | 6/1918 | Hedley et al. |
| 1,602,105 | A | 10/1926 | Geer et al. |
| 1,632,665 | A | 6/1927 | Mitchell |
| 2,238,716 | A | 4/1941 | Wells |

(Continued)

FOREIGN PATENT DOCUMENTS

| | | |
|---|---|---|
| AT | 0231900 | 2/1964 |
| AU | 226251 | 6/1959 |

(Continued)

OTHER PUBLICATIONS

International Preliminary Report on Patentability for International (PCT) Patent Application No. PCT/US2010/043950, mailed Feb. 16, 2012 7 pages.

(Continued)

*Primary Examiner* — Rachel Steitz
*Assistant Examiner* — Jennifer Gill
(74) *Attorney, Agent, or Firm* — Sheridan Ross P.C.

(57) ABSTRACT

A floor cleaning machine is provided that includes a chassis that supports at least one cleaning element and a fluid collection assembly for pooling and retaining cleaning fluids proximate to the at least one cleaning element. A floor cleaning machine is provided that includes a cleaning fluid dispersion apparatus and a cleaning fluid collection assembly for efficiently dispensing fluid on a surface for cleaning the surface, and collecting the dispensed fluid to maximize the cleaning capacity of the fluid and extend the time of a cleaning cycle.

14 Claims, 9 Drawing Sheets

(56) References Cited

U.S. PATENT DOCUMENTS 2,765,997 A 10/1956 Motts
2,893,048 A 7/1959 Martinec
2,981,966 A 5/1961 Beffel
3,010,135 A 11/1961 Pollnow, Jr.
3,011,189 A 12/1961 Sheldon
3,011,191 A 12/1961 Hulsh
3,019,465 A 2/1962 Bayless
3,064,486 A 11/1962 Aplin
3,071,793 A 1/1963 Lull
3,122,769 A 3/1964 Doersam
3,153,251 A 10/1964 Ohlson
3,186,021 A 6/1965 Krier et al.
3,189,931 A 6/1965 Peabody
3,204,280 A 9/1965 Campbell
3,277,511 A 10/1966 Little et al.
3,436,788 A 4/1969 Tamny
3,584,439 A 6/1971 Gronholz
3,639,936 A 2/1972 Ashton
3,652,044 A 3/1972 Manross
3,701,177 A 10/1972 Meyer et al.
3,733,635 A 5/1973 Carden
D228,087 S 8/1973 Kasper et al.
3,831,849 A 8/1974 Studinger
3,834,657 A 9/1974 Freitas, Jr.
3,858,761 A 1/1975 O'Dell
3,886,623 A 6/1975 Landesman et al.
3,908,220 A 9/1975 Adamson et al.
3,908,941 A 9/1975 Bromley et al.
3,923,658 A 12/1975 Lancaster
3,955,236 A 5/1976 Mekelburg
4,037,289 A 7/1977 Dojan
4,054,184 A 10/1977 Marcinko
4,069,540 A 1/1978 Zamboni
4,108,268 A 8/1978 Block
4,120,210 A 10/1978 Sloyan
4,173,056 A 11/1979 Geyer
4,178,654 A * 12/1979 Mitchell ..... 15/385
4,200,953 A 5/1980 Overton
4,246,982 A 1/1981 Pretnick
4,306,967 A 12/1981 Trautwein
4,310,944 A 1/1982 Kroll et al.
D263,037 S 2/1982 Brown
4,330,897 A 5/1982 Tucker et al.
4,355,834 A 10/1982 Alford
4,363,152 A 12/1982 Karpantry
4,367,145 A 1/1983 Simpson et al.
4,369,540 A 1/1983 Burgoon et al.
4,380,844 A * 4/1983 Waldhauser et al. ..... 15/320
4,429,433 A 2/1984 Burgoon
4,431,548 A 2/1984 Lipowski et al.
D273,620 S 4/1984 Kimzey et al.
D273,622 S 4/1984 Brown et al.
4,457,036 A 7/1984 Carlson et al.
4,457,043 A 7/1984 Oeberg et al.
D276,902 S 12/1984 Plugge
4,492,002 A * 1/1985 Waldhauser et al. ..... 15/320
4,510,643 A 4/1985 Kitada
4,554,701 A 11/1985 Van Raaij
4,561,624 A 12/1985 Freeman
4,611,363 A 9/1986 Samuelsson
4,624,026 A 11/1986 Olson et al.
4,674,048 A 6/1987 Okumura
4,675,935 A 6/1987 Kasper et al.
4,679,271 A 7/1987 Field et al.
4,700,427 A 10/1987 Knepper
4,701,893 A 10/1987 Muller et al.
4,710,020 A 12/1987 Maddox et al.
4,731,956 A 3/1988 Wood
4,736,116 A 4/1988 Pavlak, Jr. et al.
4,751,658 A 6/1988 Kadonoff et al.
4,757,566 A 7/1988 Field et al.
4,759,094 A 7/1988 Palmer et al.
4,766,432 A 8/1988 Field
4,772,875 A 9/1988 Maddox et al.
4,777,416 A 10/1988 George, II et al.
4,787,646 A 11/1988 Kamlukin et al.
4,790,402 A 12/1988 Field et al.
4,792,274 A 12/1988 Cockram
4,805,256 A 2/1989 Mason et al.
4,815,008 A 3/1989 Kadonoff et al.
4,815,840 A 3/1989 Benayad-Cherif et al.
4,819,676 A 4/1989 Blehert et al.
4,821,192 A 4/1989 Taivalkoski et al.
4,825,500 A 5/1989 Basham et al.
4,829,442 A 5/1989 Kadonoff et al.
4,846,297 A 7/1989 Field et al.
4,854,005 A 8/1989 Wiese et al.
4,884,313 A 12/1989 Zoni
4,893,375 A 1/1990 Girman et al.
4,910,824 A 3/1990 Nagayama et al.
4,939,703 A 7/1990 Muller
4,956,891 A 9/1990 Wulff
4,996,468 A 2/1991 Field et al.
5,005,128 A 4/1991 Robins et al.
5,005,597 A 4/1991 Popelier et al.
5,018,240 A 5/1991 Holman
5,020,620 A 6/1991 Field
5,031,000 A * 7/1991 Pozniakas et al. ..... 399/349
5,031,602 A 7/1991 Vick
5,032,775 A 7/1991 Mizuno et al.
5,038,484 A 8/1991 Rench et al.
5,051,906 A 9/1991 Evans, Jr. et al.
5,054,150 A 10/1991 Best et al.
5,090,083 A 2/1992 Wulff
5,093,955 A 3/1992 Blehert et al.
D329,311 S 9/1992 Knowlton et al.
D329,996 S 10/1992 Ciszewski
5,184,372 A 2/1993 Mache
5,199,793 A 4/1993 Jackson
5,212,848 A 5/1993 Geyer
5,239,720 A 8/1993 Wood et al.
5,265,300 A 11/1993 O'Hara et al.
5,279,672 A 1/1994 Betker et al.
5,280,663 A 1/1994 Proulx
5,286,302 A 2/1994 Wickham, III
5,303,448 A 4/1994 Hennessey et al.
5,307,538 A 5/1994 Rench et al.
5,349,718 A 9/1994 Gibbon
5,364,114 A 11/1994 Petersen
5,377,376 A 1/1995 Wood et al.
5,377,382 A 1/1995 Bores et al.
5,394,586 A 3/1995 Holley
5,403,473 A 4/1995 Moorehead et al.
5,413,128 A 5/1995 Butts
5,419,006 A 5/1995 Duthie
5,445,730 A 8/1995 Pattee
5,455,985 A 10/1995 Hamline et al.
5,467,500 A 11/1995 O'Hara et al.
5,479,672 A 1/1996 Brown et al.
5,485,653 A 1/1996 Knowlton et al.
5,498,329 A 3/1996 Lamminen et al.
5,513,413 A 5/1996 Myers et al.
5,524,320 A 6/1996 Zachhuber
5,555,596 A 9/1996 Knowlton et al.
5,579,555 A 12/1996 Pearse
5,601,659 A 2/1997 Rohrbacher
5,605,493 A 2/1997 Donatelli et al.
5,608,947 A 3/1997 Knowlton et al.
5,611,106 A 3/1997 Wulff
5,611,108 A 3/1997 Knowlton et al.
5,611,487 A 3/1997 Hood
5,613,270 A 3/1997 Alvarez et al.
5,615,437 A 4/1997 Takahashi et al.
5,628,086 A 5/1997 Knowlton et al.
5,630,246 A 5/1997 Knowlton et al.
D382,383 S 8/1997 Knowlton et al.
5,695,121 A 12/1997 Stillions, Jr. et al.
5,735,017 A 4/1998 Barnes et al.
5,742,975 A 4/1998 Knowlton et al.
5,746,904 A 5/1998 Lee
5,794,305 A 8/1998 Weger
5,802,665 A 9/1998 Knowlton et al.
5,833,295 A 11/1998 Farlow, Jr.
5,881,417 A 3/1999 Knowlton

(56) References Cited

U.S. PATENT DOCUMENTS

| | | | | |
|---|---|---|---|---|
| 5,940,928 | A | 8/1999 | Erko | |
| 5,958,240 | A | 9/1999 | Hoel | |
| 5,975,480 | A | 11/1999 | Schaefer et al. | |
| RE36,565 | E | 2/2000 | Burgoon et al. | |
| 6,021,792 | A | 2/2000 | Petter et al. | |
| 6,023,813 | A | 2/2000 | Thatcher et al. | |
| 6,042,702 | A | 3/2000 | Kolouch et al. | |
| 6,073,304 | A | 6/2000 | Knowlton et al. | |
| 6,088,873 | A | 7/2000 | Pacchini et al. | |
| 6,106,712 | A | 8/2000 | New | |
| 6,108,859 | A * | 8/2000 | Burgoon | 15/320 |
| 6,132,509 | A | 10/2000 | Kuschnereit | |
| 6,132,599 | A | 10/2000 | Chaffee | |
| 6,163,923 | A | 12/2000 | Hefter | |
| 6,189,755 | B1 | 2/2001 | Wakefield | |
| 6,206,980 | B1 | 3/2001 | Robinson | |
| 6,212,731 | B1 | 4/2001 | Eckerlein et al. | |
| 6,234,408 | B1 | 5/2001 | Stevens et al. | |
| 6,234,409 | B1 | 5/2001 | Aslakson | |
| 6,249,926 | B1 | 6/2001 | Wulff | |
| 6,295,682 | B1 | 10/2001 | Klucznik | |
| 6,301,848 | B1 | 10/2001 | Whitaker | |
| 6,346,197 | B1 | 2/2002 | Stephenson et al. | |
| 6,349,715 | B1 | 2/2002 | McBroom | |
| 6,416,101 | B1 | 7/2002 | Bartch | |
| 6,425,958 | B1 | 7/2002 | Giddings et al. | |
| 6,442,789 | B1 | 9/2002 | Legatt et al. | |
| 6,495,048 | B2 | 12/2002 | Stephenson et al. | |
| 6,530,117 | B2 | 3/2003 | Peterson | |
| 6,550,692 | B1 | 4/2003 | Schacht | |
| 6,553,609 | B2 | 4/2003 | Tremmel et al. | |
| 6,557,207 | B2 * | 5/2003 | Stuchlik | 15/401 |
| 6,575,858 | B2 | 6/2003 | Green et al. | |
| 6,602,018 | B2 | 8/2003 | Feeny et al. | |
| 6,641,721 | B2 | 11/2003 | Mulierheim | |
| 6,655,396 | B2 | 12/2003 | Krenzel | |
| 6,663,783 | B2 | 12/2003 | Stephenson et al. | |
| 6,715,517 | B2 | 4/2004 | Tobin | |
| 6,766,822 | B2 | 7/2004 | Walker | |
| 6,790,349 | B1 | 9/2004 | Sawyer | |
| 6,799,591 | B2 | 10/2004 | McCormick et al. | |
| 6,842,940 | B2 * | 1/2005 | Christopher et al. | 15/320 |
| 6,880,199 | B1 | 4/2005 | Huffman et al. | |
| 6,896,742 | B2 | 5/2005 | Geyer et al. | |
| 6,932,412 | B1 | 8/2005 | Paproski | |
| D510,545 | S | 10/2005 | Riegel et al. | |
| 6,964,820 | B2 | 11/2005 | Shimonosono et al. | |
| 6,971,137 | B2 | 12/2005 | Pierce et al. | |
| 7,025,835 | B2 | 4/2006 | Pedlar et al. | |
| 7,066,096 | B1 | 6/2006 | Harker et al. | |
| 7,118,633 | B2 | 10/2006 | Jenkins | |
| 7,121,288 | B2 | 10/2006 | Jenkins | |
| 7,160,472 | B2 | 1/2007 | Van Vliet et al. | |
| 7,185,397 | B2 | 3/2007 | Stuchlik et al. | |
| 7,203,979 | B2 | 4/2007 | O'Brien | |
| 7,225,841 | B2 | 6/2007 | Folk | |
| 7,258,749 | B2 | 8/2007 | McCormick et al. | |
| 7,287,299 | B2 * | 10/2007 | Joynt | 15/320 |
| D555,303 | S | 11/2007 | Taylor et al. | |
| 7,328,758 | B2 | 2/2008 | Ruffo | |
| 7,337,490 | B2 | 3/2008 | Goff | |
| D566,624 | S | 4/2008 | Dempsey et al. | |
| 7,350,264 | B2 | 4/2008 | Bedard et al. | |
| D572,212 | S | 7/2008 | Taylor et al. | |
| 7,430,782 | B2 | 10/2008 | Ruffo | |
| 7,431,835 | B2 | 10/2008 | Lack | |
| 7,530,362 | B2 | 5/2009 | McCormick et al. | |
| 7,533,435 | B2 * | 5/2009 | Pedlar et al. | 15/49.1 |
| 7,635,333 | B2 | 12/2009 | Watanabe et al. | |
| 7,716,785 | B2 * | 5/2010 | Coccapani et al. | 15/402 |
| 7,775,221 | B2 | 8/2010 | Zeile | |
| D626,461 | S | 11/2010 | Barrios et al. | |
| 8,245,345 | B2 * | 8/2012 | Pedlar et al. | 15/49.1 |
| 2002/0050014 | A1 * | 5/2002 | Stuchlik | 15/50.1 |
| 2004/0031113 | A1 | 2/2004 | Wosewick et al. | |
| 2005/0251937 | A1 | 11/2005 | Ruffo | |
| 2006/0118149 | A1 | 6/2006 | Benson et al. | |
| 2006/0273622 | A1 | 12/2006 | Laird | |
| 2007/0056510 | A1 | 3/2007 | Antaya | |
| 2007/0157417 | A1 | 7/2007 | O'Hara | |
| 2007/0192973 | A1 | 8/2007 | Eklund et al. | |
| 2008/0000507 | A1 | 1/2008 | Snyder et al. | |
| 2008/0229538 | A1 | 9/2008 | Goff | |
| 2009/0062046 | A1 | 3/2009 | Lindemann | |
| 2009/0065442 | A1 | 3/2009 | Taylor et al. | |
| 2009/0188535 | A1 | 7/2009 | Taylor et al. | |

FOREIGN PATENT DOCUMENTS

| | | |
|---|---|---|
| CA | 2298122 | 7/2001 |
| DE | 1628617 | 4/1971 |
| DE | 2119028 | 11/1978 |
| EP | 0310093 | 4/1989 |
| EP | 0447601 | 9/1991 |
| EP | 0940735 | 9/1999 |
| GB | 1112147 | 5/1968 |
| JP | H10-314088 | 12/1998 |
| JP | 2002-238820 | 8/2002 |
| JP | 2008-157819 | 7/2008 |
| JP | 2009-521284 | 6/2009 |
| WO | WO 89/06624 | 7/1989 |
| WO | 2010107432 * | 9/2010 |

OTHER PUBLICATIONS

Official Action for Australian Patent Application No. 2010279651 dated Mar. 17, 2014, 6 pages.

Official Action (English summary) for Japanese Patent Application No. 2012-523672 dated Apr. 15, 2014, 2 pages.

Extended Search Report for European Patent Application No. 10806966.7, dated Sep. 25, 2013 8 pages.

U.S. Appl. No. 12/480,515, filed Jun. 8, 2009, Mortensen et al.

U.S. Appl. No. 12/730,066, filed Mar. 23, 2010, Barrios et al.

U.S. Appl. No. 12/730,075, filed Mar. 23, 2010, Barrios et al.

U.S. Appl. No. 12/762,977, filed Apr. 19, 2010, Barrios et al.

Tennant Model 1465 and 1480 Manual, 1988, pp. 3-18 and 6-34.

"Washwater treatment ElectroPulse Technology", Oil Trap Inc., Recycling Product News, Jul.-Aug. 2005, p. 1.

"Danron Enterprises Electro-Coagulation Treatment (ECT) System Performance Claim", Environmental Technology Verification (ETV) Program website, as early as Mar. 2006, available at http://www,etvcanada.ca/F/data/PDF_Danron.pdf, pp. 1-2, printed on Apr. 6, 2007.

Diterlizzi, "Introduction to Coagulation and Flocculation of Wastewater", Term Project/Environmental Systems Project, Fall 1994, available at http://www.rpi.edu/dept/chem-eng/Biotech-Environ/COAG/coag.htm, pp. 1-4, printed on Apr. 6, 2007.

"Hydropad Portable Wash Pad: Hydropads have the following features:", ecosentry website, as early as 2005, available at http://www.ecosentry.com.au/hydropad, pp. 1-3, printed on Aug. 10, 2006.

"Hydropad Portable Wash Pad", HE HYDROengineering website, as early as 2004, available at http://www.hydroblaster.com/HydropadPortableWashRack.html, pp. 1-11, printed on Aug. 10, 2006.

"Applications: The Drive-On Wash Pad-design your own wash pad", EZ Environmental Solutions Corporation website, date unknown, available at http://www.ezenvironmental.com/product.asp-?page=1224, pp. 1-3, printed on Aug. 10, 2006.

"Cyclonator: Pumping & Polution Control Solutions", Megator website, as early as Dec. 12, 2004, available at http://www.megator.com/cyclonator.htm, pp. 1-2, printed on Aug. 10, 2006.

International Search Report for International (PCT) Patent Application No. PCT/US2010/043950, mailed Sep. 22, 2010.

Written Opinion for International (PCT) Patent Application No. PCT/US2010/043950, mailed Sep. 22, 2010.

* cited by examiner

METHOD AND APPARATUS FOR EXTENDED USE OF CLEANING FLUID IN A FLOOR CLEANING MACHINE

FIELD OF THE INVENTION

The present disclosure is generally related to floor cleaning machines. More specifically, one embodiment of the present disclosure is a floor cleaning machine that includes cleaning fluid dispensing apparatus and a cleaning fluid collection assembly for efficiently dispensing and maintaining an amount of fluid on a surface for cleaning the surface, and collecting the dispensed fluid to maximize the cleaning capacity of the fluid.

BACKGROUND

A variety of machines for cleaning a surface such as a carpeted floor are available for both residential and commercial use, and are well known in the art. For example, prior art floor cleaning machines are described in U.S. Pat. Nos. 3,908,220, 4,178,654, 4,805,256 and 7,025,835, all of which are incorporated by reference herein in their entireties. Certain prior art floor cleaning machines are operated by a single hand of a user, while others are larger and more elaborate and require a user to steer the machine by walking behind or riding on the machine while manipulating the machine's controls. Floor cleaning machines of the walk behind or ride on variety are generally comprised of a chassis supported by a plurality of wheels, one or more of which is steerable to control the path of the machine. The chassis may be directed by the use of a steerable wheel or stick, which is coupled to a steering mechanism comprised of various gears. The chassis may further be propelled by one or more drive mechanisms. The chassis may also accommodate a number of different cleaning apparatus, such as fluid dispensing and collection apparatus, a brush, a squeegee, a burnisher, and/or other implements for cleaning and/or polishing a floor surface.

The chassis typically supports tanks used to hold cleaning fluids, as well as spent cleaning fluids suctioned from the floor. Typically, the larger the capacity of the fluid holding tank(s), the longer the cleaning machine may be operated before replacing cleaning fluid and removing spent fluid. Due in part to the high number of component parts required to operate the cleaning machine, and also due in part to the relative size limitations of the cleaning machines, the tanks used to hold cleaning fluid and spent cleaning fluid are relatively limited in capacity. For example, as floor cleaning machines are often used in tight spaces, such as bathrooms and hallways, it is desirable to make floor cleaning machines as compact as possible, which may cause a reduction in the size of the fluid holding tanks. Many of the components associated with the cleaning machine are typically surrounded by a housing to protect the internal components from the environment. Individuals that are working around the machine are also prevented from touching the sometimes moving and often hot internal components. Thus, the size of the tanks used to store fluids is often reduced as a result of these and other constraints.

There is also a problem associated with maintaining the various cleaning implements used for cleaning or polishing a floor surface in a lubricated state. Dry brushes are generally viewed as being less efficient in cleaning a floor surface. Therefore, fluid is dispensed on to the brushes of a cleaning machine, often throughout the cleaning cycle and at a near constant flow rate, in order to keep the brushes lubricated enough to achieve the desired scrubbing action against the floor surface. This near constant fluid flow rate also places constraints on the duration of the cleaning cycle, as the user must stop the machine in order to add new cleaning fluid and remove spent fluid, thereby adding to the entire time required to clean a surface. Additionally, brushes used to clean carpeted floor surfaces, which are often robust and designed for repeated use, must be lubricated with a sufficient amount of cleaning fluid in order to effectively clean the carpeted floor surface (i.e., the brush must be lubricated to a certain degree in order that its scrubbing action loosens soils that may be present and entrains the soils in the fluid for removal).

Thus, it is important to optimize the use of fluid required to lubricate the brushes or other cleaning implements of the cleaning machine. If the fluid is dispensed too quickly, the supply tank is depleted too quickly and the operator has to cease operation of the machine to refill the cleaning fluid tank. As a result, it takes more time and uses more cleaning fluid to clean a surface, which typically results in additional time to allow the surface to dry before it may be traveled on or otherwise used again. By reducing the flow of cleaning fluid, while at the same time maintaining the brushes in a sufficiently lubricated state, a user is able to operate the cleaning machine longer and thereby prolong or extend each cleaning cycle (defined by the capacity of the cleaning fluid tank), and reduce stoppages for replacing and removing the fluids in the cleaning machines.

Additionally, typical prior art cleaning machines of the ride on type have a constant rate of travel, which often does not permit the brushes and other implements to contact the surface long enough to effectuate cleaning of the surface. This effect is exacerbated by the machine's changing of direction, often zig-zag pattern of travel, initial time to saturate the brushes or other implements, etc. Therefore, the fluid is dispensed enough to saturate the brush but not adequately lubricate the surface to allow soils to be removed from the surface.

U.S. Pat. No. 7,025,835 to Pedlar et al., discloses a dual brush scrubbing assembly, which comprises two rigid barriers (90a, 90b) bracketed adjacent to each of the two brushes (64, 68). However, these barriers do not serve the same purpose as the squeegee assembly (29), which is separate and apart from the barriers (90a, 90b), as the barriers are rigid and continuously contact the floor surface (i.e., there are no apertures or conduits for cleaning fluid to pass therethrough). In addition, the Pedlar patent relies on the motion of the brushes to urge cleaning fluid back into the center of the scrubbing assembly, rather than on relying on the barriers to puddle or pool water between the barriers and the brushes. Furthermore, these barriers are not allowed to move to address changes in direction, and there is no associated fluid collection apparatus for cleaning fluid that avoids the barriers while the floor cleaning machine is in use. Although Pedlar does disclose an embodiment where the cleaning fluid is permitted to escape (by reducing the height of a section of extender member 104), this open area is disclosed as being at the front of the scrubbing assembly (not the rear), and is designed primarily for releasing surface materials suspended or dissolved in the fluid. Thus, the Pedlar patent does not address the problems associated with spent cleaning fluid remaining in the vicinity of the cleaning brushes, which in turn causes fluid entrained with soils or dirt to be deposited back onto the floor surface. This entrained or spent cleaning fluid is also permitted to travel beyond the limited range of the barriers while the floor cleaning machine is in motion and during changes of direction, thereby creating further problems with spent cleaning fluid being left on the floor surface and not collected by the spent cleaning fluid holding tank.

U.S. Patent Application Publication No. 2005/0251037 to Ruffo discloses a floor cleaning machine with a trailing floor wiper arranged at the rear of a brush associated with the cleaning machine, which travels in the direction of the cleaning machine including when the cleaning machine changes direction. Although the Ruffo patent publication discloses an oscillating floor wiper, the oscillation of the floor wiper is based on friction caused by the wiper sliding on the floor surface (see ¶[0031]). Furthermore, the floor wiper is in continuous contact with the floor surface when the floor cleaning machine is in use, and does not have any apertures or other conduit for cleaning fluid to be collected from and removed from the floor surface while the cleaning machine is in use. And lastly, the floor wiper of Ruffo is spaced a distance away from the brush such that a substantial portion of any pooled cleaning fluid is not in contact with the brush while the floor cleaning machine is in use (see, e.g., FIG. 1). Ruffo also suffers from the same shortcomings as Pedlar in that it does not address the removal of spent cleaning fluid after it has become entrained with dirt or soil, yet remains in contact with the floor and the brush due to the rigid floor wiper and lack of aperture(s) or conduit(s) for removing spent cleaning fluid.

Thus, there is a long felt need to provide a floor cleaning machine that is compact yet allows for efficient and controlled dispensing and maintaining of cleaning fluid on the floor surface that extends the cleaning capacity of the cleaning fluid, and that allows for a more controlled collection of spent cleaning fluid during the cleaning process. The following disclosure describes an improved floor cleaning machine that includes a cleaning fluid collection assembly that cooperates with cleaning fluid dispensing apparatus for accomplishing this objective. Other objectives accomplished and other problems solved by the present disclosure are described in the Summary and Detailed Description below.

SUMMARY

Given the nature of these problems and design considerations, it is important that cleaning machines maximize the efficiency of cleaning fluid dispensed and eliminate unnecessary downtime for refilling cleaning fluid tanks between cleaning cycles. In particular, it is desirable to effect a pooling of cleaning fluid on the floor surface, at least partially overlapping the area in contact with the brush, so that the brush may continually pass through the pooling area and clean the surface, thereby maintaining lubrication of the brush and extending the time that the pooled cleaning fluid is available for a particular cleaning cycle. As many brushes are rotational, it is possible to have this area of overlap be less than the entire surface area of the brush, as the rotation of the brush and the movement of the cleaning machine permit fluid to be distributed from the portion of the brush that passes through the pooling area, to the floor surface, and back to the area of the brush that do not pass through the pooling area. In this manner, it is possible to provide a more optimal use of cleaning fluid, and extend the duration of the cleaning cycle.

It is also an important consideration that fluid deposited on a surface does not remain too long on the surface before collection. In general, it is desirable to collect those spent fluids within a controlled time after the cleaning fluid is introduced to the brush and the floor surface. In this context, it is desirable to use pooled cleaning fluid as long as possible, in order to optimize the volume of dirt picked up by the cleaning fluid—otherwise cleaning fluid will be wasted. Therefore, whether or not new cleaning fluid is introduced periodically or continuously during the cleaning cycle, it is desirable to have the pooled cleaning fluid removed from the pooling area in a controlled manner in order to improve performance by extending a unit volume of cleaning fluid over a larger surface area. This improved efficiency permits a user of the cleaning machine to increase the floor surface area that may be cleaned during the time the cleaning fluid tank contains any remaining fluid (and the spent cleaning fluid tank is not at capacity). In turn, this reduces the number of times the tank of cleaning fluid must be refilled and thereby reduces the time to clean a surface.

It is one aspect of the embodiment of the present disclosure to provide a floor cleaning machine that includes a chassis that is supported by a plurality of wheels, and houses storage tanks for holding unused cleaning fluids and spent cleaning fluids. The cleaning machine preferably comprises at least one steering mechanism, which may employ a plurality of gears that transfer rotational inputs from a steering wheel to rotation of the gears that ultimately alter the orientation of at least one wheel and thereby affect the direction of travel of the machine. The chassis also supports floor cleaning apparatus, such as a brush(es), squeegee(s), spray nozzle(s), etc., all of which are described in, for example, U.S. Pat. No. 7,533,435 entitled "Floor Treatment Apparatus", which is incorporated by reference in its entirety herein.

In a preferred embodiment, the cleaning machine comprises a fluid collection assembly that is located behind a scrubbing assembly (in relation to the direction of travel of the floor cleaning machine) when it is scrubbing a floor surface. One or more squeegees are provided in the fluid collection assembly that serve to control and collect cleaning fluid that is deposited on the brush or on the floor surface so that the cleaning fluid pools or "puddles" in an area adjacent the one or more squeegees. The one or more squeegees maintain a source of cleaning fluids for use by the scrubbing assembly for a longer period of time. In one or more embodiments, a plurality of apertures are formed in the one or more squeegees, whereby the plurality of apertures are in fluid communication with a vacuum or similar apparatus for controlling the amount of pooled cleaning fluid, and for removing cleaning fluid as it becomes entrained with dirt.

In operation, the efficiency of the cleaning machine is improved by pooling cleaning fluid such that the brush moves through the pooled area and recirculates the cleaning fluid to the floor surface and to other parts of the brush that do not directly move through the pooling area. The cleaning fluid is available for a longer period of time as an available source of lubrication for the brush to clean the floor surface. The combination of the squeegee, strategically placed apertures in the squeegee and fluid pickup from a vacuum source combine to permit more efficient use of the cleaning fluid and to increase the time the cleaning machine may be continuously operated without stopping to refill the clean fluid tank or remove the spent fluid.

In varying embodiments of the present disclosure, a number of different types of cleaning machines may incorporate the novel aspects of the fluid collection assembly described herein. But in a preferred embodiment, the cleaning machine is a powered, ride-on type cleaning machine, which further includes a housing, which is comprised of a primary housing directly interconnected to the chassis. The primary housing may have a plurality of removable segments that allow selective access to the interior of the floor cleaning device or may be of one piece construction that surrounds all internal components of the floor cleaning machine. The primary housing may be removable from the chassis in any number of ways known in the art. The housing segment may also comprise a secondary housing component selectively rotatable from the primary housing to allow access to internal components covered thereby, either from the rear or the top of the floor cleaning machine. According to one embodiment, a cleaning machine of the type generally described in U.S. Pat. No. 7,533,435 may incorporate one or more of the features described in greater detail herein.

According to other embodiments, the cleaning machine comprises a fluid collection assembly that is coupled to the cleaning machine but that is allowed to pivot about a central axis. This pivoting movement in turn allows the fluid collection assembly to move laterally when the cleaning machine changes direction, and in doing so prevents pooled cleaning fluid from being carried away from the one or more squeegees. The fluid collection assembly and the one or more squeegees retain the pooled cleaning fluid even during tight turns during the operation of the cleaning machine, according to this embodiment. The pivoting of fluid collection assembly may be controlled directly by rotation of the steering mechanism, such that as the cleaning machine turns the fluid collection assembly moves to a new position to counteract the motion of the cleaning machine. Alternatively, the fluid collection assembly may freely pivot about an axis and reposition itself based upon changes in momentum caused by movement of the cleaning machine.

This Summary is neither intended nor should it be construed as being representative of the full extent and scope of the present disclosure. Moreover, references made herein to "the present disclosure" or "the invention" or aspects thereof should be understood to mean certain embodiments of the invention and should not necessarily be construed as limiting all embodiments to a particular description. The present disclosure is set forth in various levels of detail in the Summary as well as in the attached drawings and the Detailed Description, and no limitation as to the scope of the present disclosure is intended by either the inclusion or non-inclusion of elements, components, etc. in this Summary. Additional aspects of the present disclosure will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention. The drawings together with the general description of the invention given above and the Detailed Description of the drawings given below, serve to explain the principles of various embodiments of the present disclosure. The drawings provided with this disclosure, which are not necessarily to scale, include the following.

Figure 1:
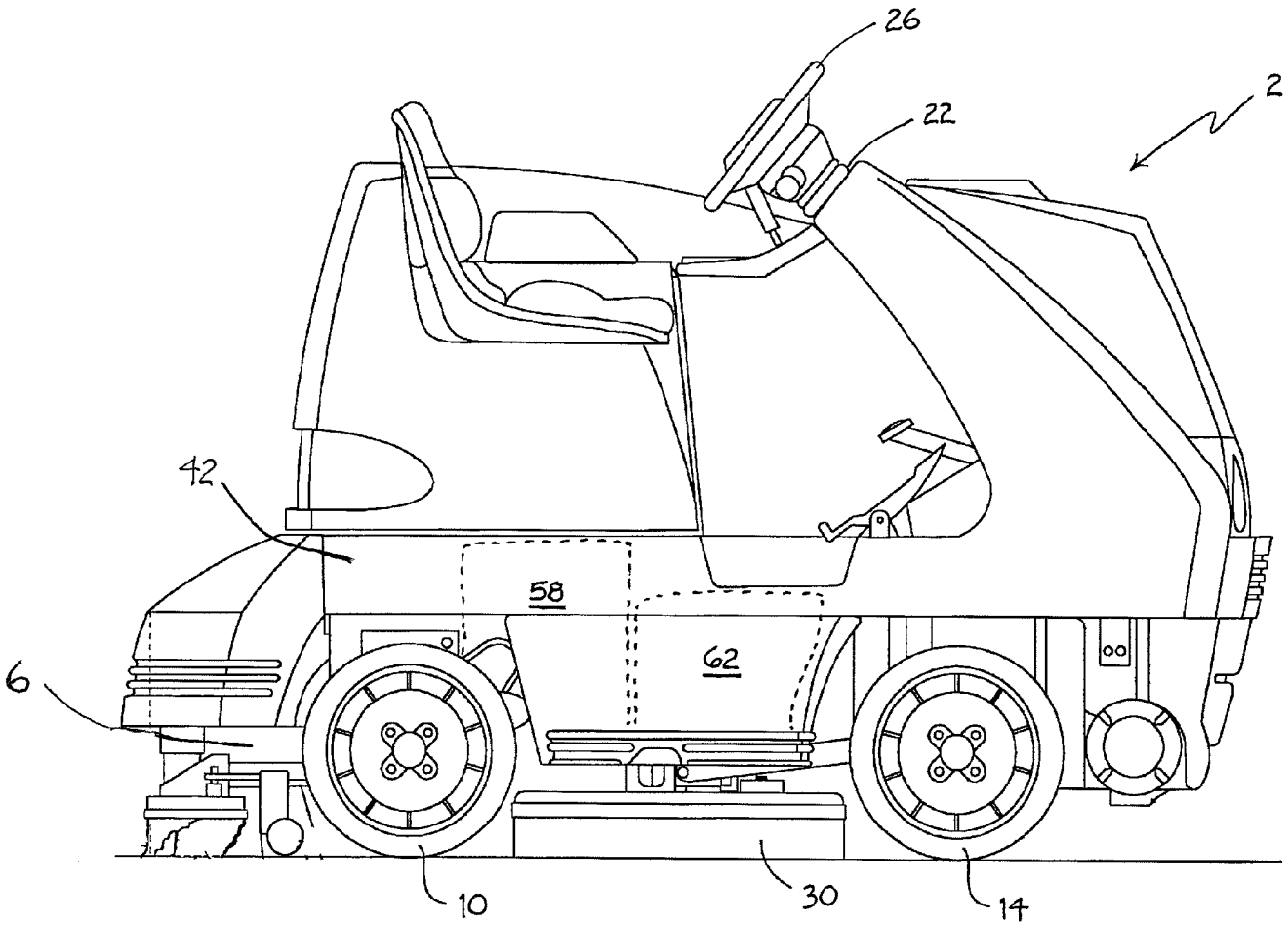
FIG. 1 (Prior Art)
FIG. 1 is an elevation view of a prior art cleaning machine shown in cross-section.

To assist in the understanding of one embodiment of the present disclosure the following list of components and associated numbering found in the drawings is provided herein:

| Ref. No. | Components |
|---|---|
| 2 | Floor cleaning machine |
| 6 | Chassis |
| 10 | Rear wheel(s) (of floor cleaning machine) |
| 14 | Front wheel(s) (of floor cleaning machine) |
| 22 | Steering shaft |
| 26 | Steering wheel |
| 30 | Cleaning apparatus |
| 42 | Primary housing |
| 54 | Scrubbing assembly |
| 55 | Central axis |
| 57 | Motor |
| 58 | Spent fluid holding tank |
| 59 | Gearbox |
| 59S | Shaft (of gearbox) |
| 61 | Skirt |
| 62 | Clean fluid holding Tank |
| 63 | Coupling device |
| 82 | Bracket assembly |
| 83 | Arms (of bracket assembly) |
| 84 | Fluid collection assembly |
| 85 | Connection Member |
| 92a | Squeegee (or first squeegee) |
| 92b | Second squeegee |
| 95 | Vacuum tube |
| 96 | Apertures (in Squeegee) |
| 99 | Wheels (of fluid collection assembly) |
| 102 | Brush |
| 107, 109 | Valve(s) |
| 108 | Retention area |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIG. 1, a floor cleaning machine 2 of the ride-on type (prior art) is shown that is generally comprised of a chassis 6 that is supported by two rear wheels 10 and a steerable front wheel(s) 14. The front wheel(s) 14 is/are associated with a steering wheel 26 that is also interconnected to the chassis 6 by a steering shaft 22. The chassis 6 also supports at least one cleaning apparatus 30 and a primary housing 42. According to one embodiment, portions of housing 42 are capable of rotating or pivoting away from chassis 6 to reveal one or more fluid holding tanks, such as a spent fluid holding tank 58 and a clean fluid holding tank 62. The primary housing 42 may be capable of pivoting or otherwise moving away from the chassis 6, thereby permitting a user to access the fluid holding tanks 58, 62 when the cleaning machine 2 is not in use.

The floor cleaning machine 2 shown in FIG. 1 may also enclose various components such as vacuum motors, pumps, valves, hoses, and other mechanical and electrical components. The front wheel(s) 14, which is/are steerable, and the rear wheels 10, which generally are not steerable, are associated with and support the chassis 6, and along with the steering shaft 22 (via steering wheel 26) control the direction of travel of the cleaning machine 2. At least one cleaning apparatus 30 is also associated with the chassis 6. One skilled in the art will appreciate that the cleaning apparatus may comprise numerous apparatus, such as a brush(es), scrubber(s), burnisher(s), squeegee(s), spray nozzle(s), spent fluid pick-up mechanism(s), etc., many of which are described in detail in previously incorporated U.S. Pat. No. 7,533,435.

Figure 2A:
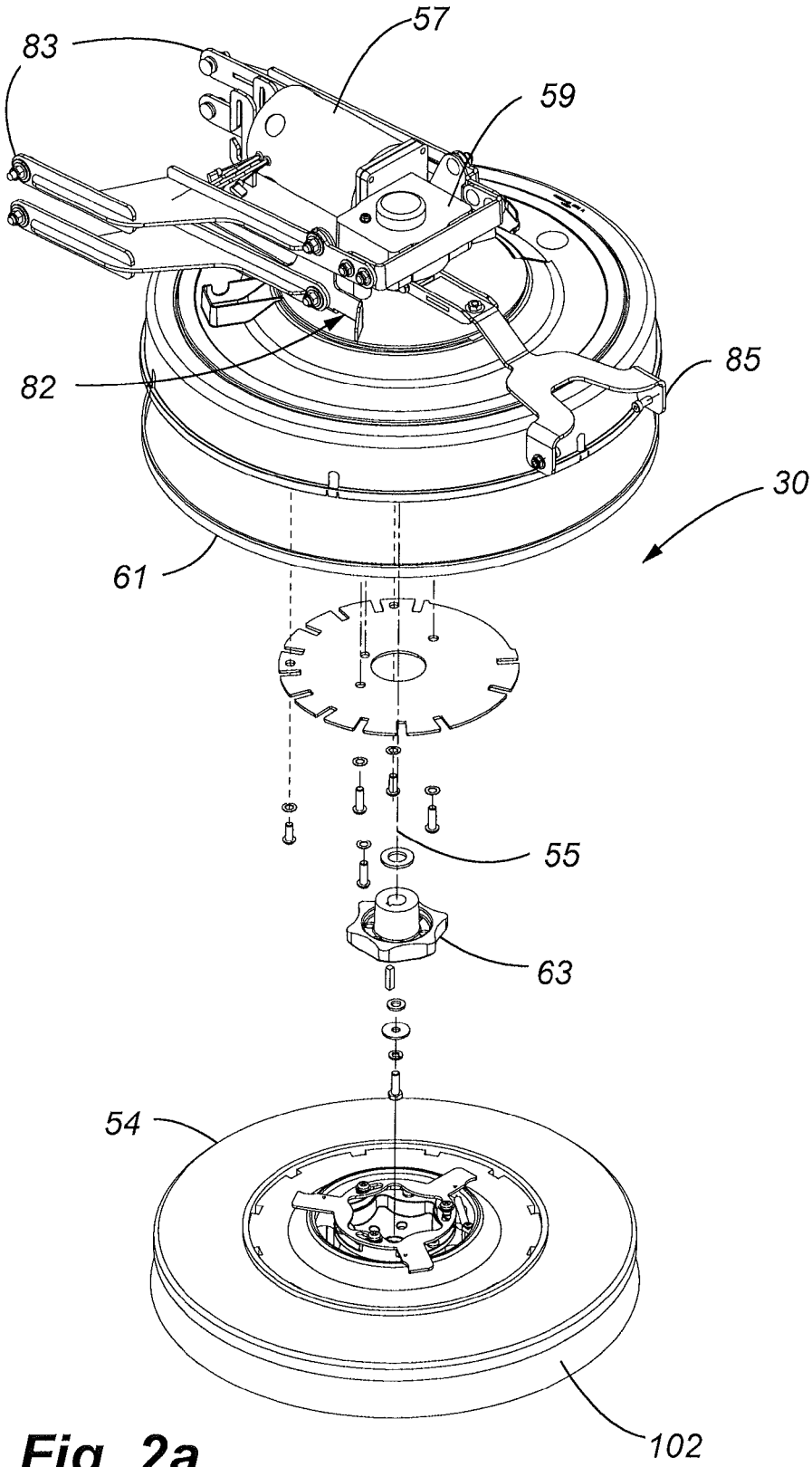
FIG. 2*a* is a perspective view of the cleaning apparatus of the cleaning machine according to one embodiment.
Figure 2B:
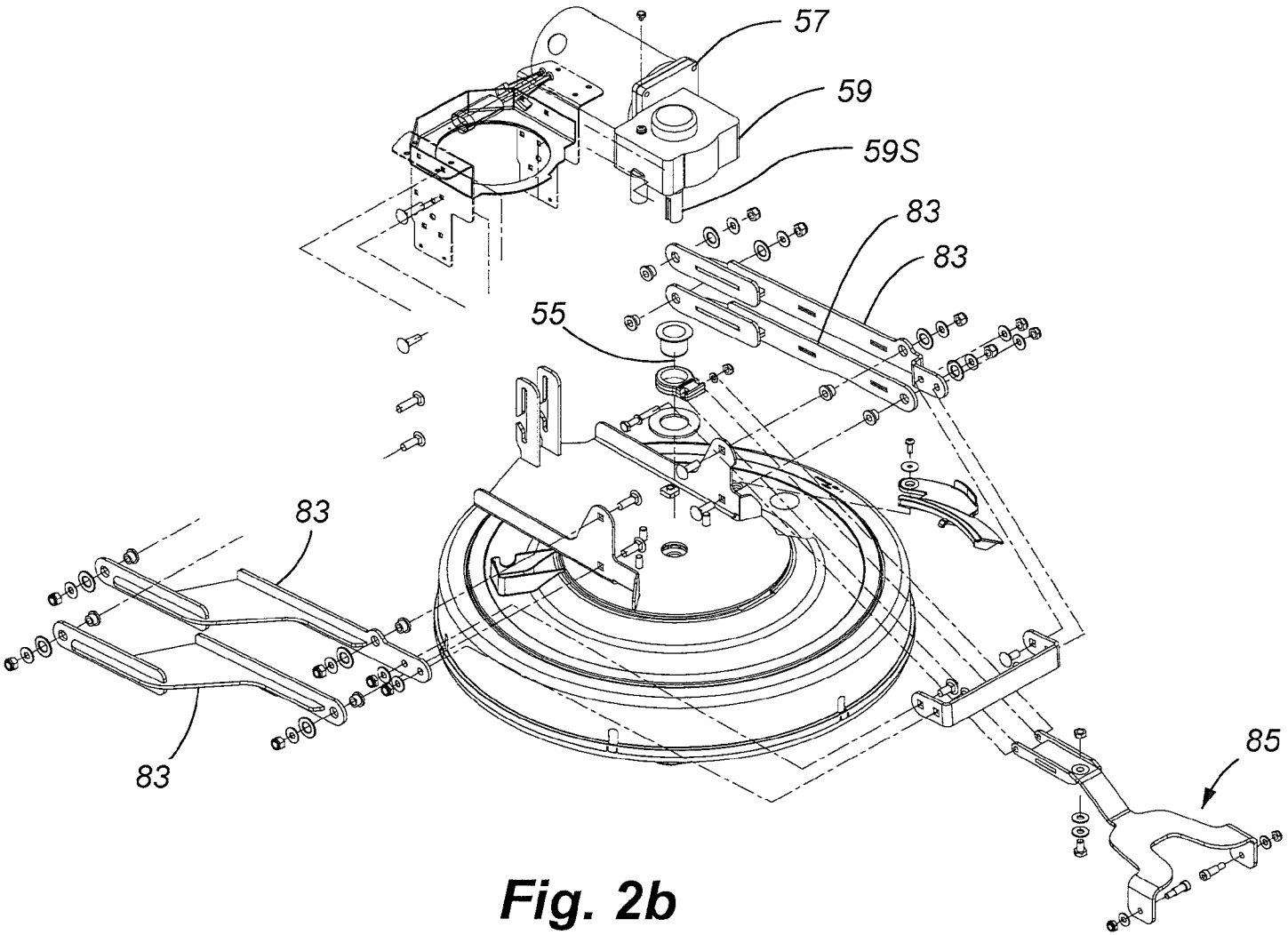
FIG. 2*b* is an exploded perspective view of the cleaning apparatus of FIG. 2*a;*

Referring now in detail to FIGS. 2*a* and 2*b*, a cleaning apparatus 30 according to a preferred embodiment is shown, which may be incorporated with, by way of example but not limitation, a cleaning machine such as the one described above in connection with FIG. 1. The cleaning apparatus 30 comprises a scrubbing assembly 54, which preferably includes at least one generally circular brush 102, which is rotatable about a central axis 55 and is powered by a motor 57 coupled to a gearbox 59. Cleaning apparatus 30 preferably comprises a skirt 61 to reduce splashing and contain cleaning fluid, a coupling device 63 for attaching scrubbing assembly 54 to the shaft of gearbox 59, and a bracket assembly 82. The bracket assembly 82 is comprised of one or more arms 83 that extend in a generally horizontal plane, for coupling to the chassis 6 of the cleaning machine 2. The bracket assembly 82 is further comprised of at least one connection member 85 for attaching a fluid collection assembly (not shown in FIG. 2*a*).

An exploded view of the cleaning apparatus 30 is shown in FIG. 2*b* (not depicting the scrubbing assembly 54), with the motor 57, coupled to the gearbox 59, which is shown centrally aligned about the central axis 55. The shaft (shown in FIG. 2*b* as 59S) of gearbox 59 is engageable with coupling device 63 as seen in FIG. 2*a*. Arms 83 are affixed to the cleaning apparatus 30, preferably by fasteners such as threaded screws, at more than one location on aims 83 to affect rotation of the arms 83 about the central axis 55 of cleaning apparatus 30 (described in greater detail in connection with FIG. 4 below). Arms 83 may vary in length and may be asymmetrical in relation to the central axis 30 (as shown in FIG. 2*b*) or symmetrical about central axis 55 as required to operate with cleaning machines. Other components not necessarily essential to the operation of the cleaning apparatus 30 are also depicted in FIGS. 2*a* and 2*b*. Less than all components may be incorporated with the cleaning apparatus 30 without departing from the novel aspects of the present disclosure described herein.

Figure 3A:
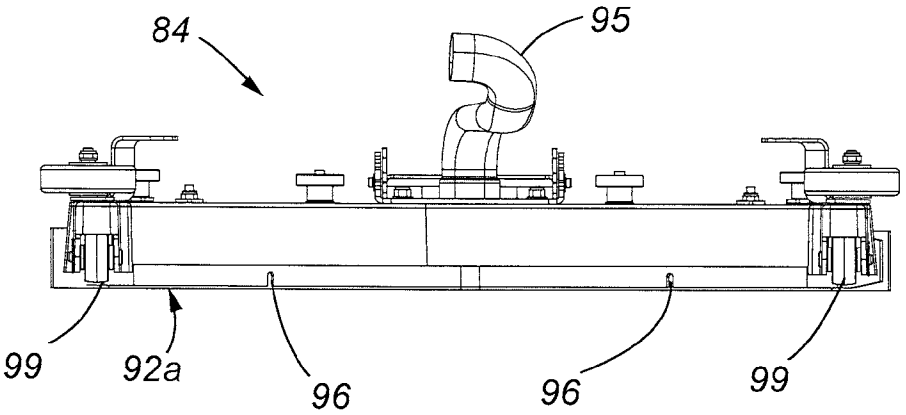
FIG. 3*a* is a side perspective view of the fluid collection assembly according to one embodiment.
Figure 3B:
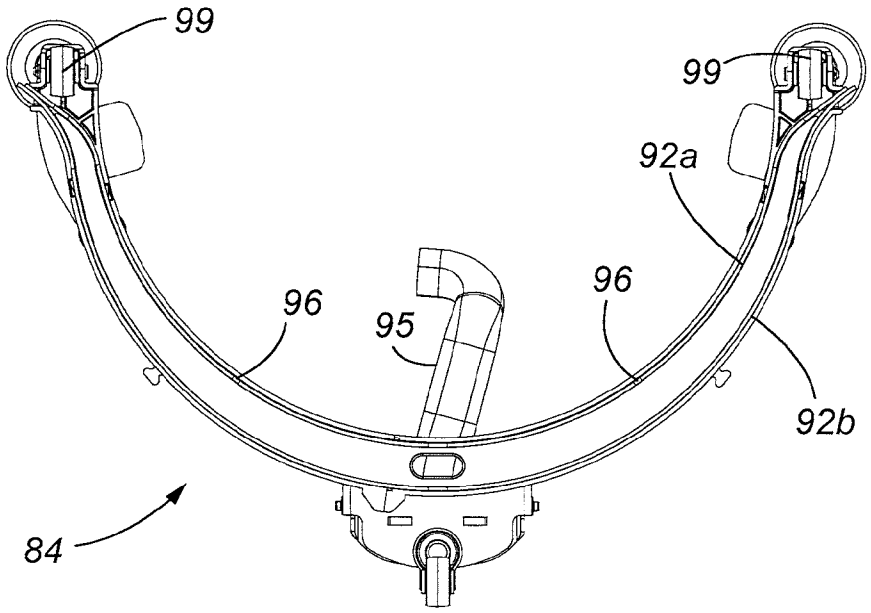
FIG. 3*b* is a bottom perspective view of the fluid collection assembly of FIG. 3*a;*

Referring now to FIGS. 3*a* and 3*b*, the fluid collection assembly 84 according to a preferred embodiment is shown. FIG. 3*a* depicts the fluid collection assembly 84 in an elevation view, while FIG. 3*b* depicts fluid collection assembly 84 in a plain view. The fluid collection assembly 84 is a generally contoured to mirror the shape or contour of the cleaning brush. In the embodiment shown, the brush (not shown) is circular in design and the fluid collection assembly 84 is formed in a generally arcuate shape to follow the shape of the brush, generally.

As illustrated, the fluid collection assembly 84 preferably covers about a 180° radius of the brush, but may cover more or less depending upon various application parameters. The fluid collection assembly 84 comprises at least one squeegee 92*a* for directing cleaning fluid on the floor surface to a vacuum tube 95. The vacuum tube 95 is further connected, preferably via a flexible or accordion style hose (not shown), to the spent fluid holding tank 58.

The squeegee 92*a* according to this embodiment, is designed to contact the floor surface such that it blocks and collects the cleaning fluid introduced from cleaning fluid tank 62, trapping a volume of the cleaning fluid against the surface of the squeegee 92*a* while the floor cleaning machine 2 is in motion. Removal of the cleaning fluid by the vacuum tube 95 is controlled by the number, size and location of one or more apertures 96 located along the bottom surface of squeegee 92*a*, as well as the power of the suction created by the associated vacuum. As illustrated, the preferred embodiment comprises two apertures 96 spaced a distance apart from the mid-point of the squeegee 92*a*. These apertures 96 and their size and location are described in greater detail below in relation to FIGS. 5-9.

Referring now in detail to FIG. 3*b*, the fluid collection assembly 84 according to a preferred embodiment comprises two squeegees 92*a* and 92*b* which are offset and create a void or space therebetween, between which spent cleaning fluid may be directed via apertures 96 to vacuum tube 95. The second squeegee 92*b* is spaced a greater distance away from brush 102 than squeegee 92*a* and preferably does not have any apertures. Squeegee 92*b* serves to collect the cleaning fluid that has passed through the apertures 96 of the first squeegee 92*a* and to direct the cleaning fluid to the vacuum tube 95. Due to the generally arcuate shape of the squeegee 92*a*, any cleaning fluid that collects against the surfaces of the squeegees 92*a* will tend to pool or collect on the brush side of squeegee 92*a*, forming a pool or puddle against the squeegee 92*a* between the apertures 96. Once the cleaning fluid collects to a volume such that the pool reaches the apertures 96, the vacuum pressure from vacuum tube 95 causes the cleaning fluid to travel between squeegees 92*a* and 92*b* and carried along the arcuate contour of squeegee 92*b* to the midpoint of squeegee 92*b*, where it may be removed through the vacuum tube 95 to the spent fluid holding tank 58. A vacuum motor or similar apparatus provides vacuum pressure to the vacuum tube 95, thereby suctioning spent cleaning fluid via apertures 96 from the floor surface, and depositing it in the spent fluid holding tank 58, but not before allowing a sufficient amount of cleaning fluid to pod in the area of the brush.

In another aspect of the invention, the fluid collection assembly 84 is generally pivotable about the central axis 55 of the cleaning apparatus 30, allowing the fluid collection assembly 84 to shift in position in association with movement and travel of the cleaning machine 2. This means of pivoting the fluid collection assembly is due, in part, to the interconnection with bracket assembly 82 and the plurality of wheels on rollers 99 which support and position the fluid collection assembly 84 and squeegees 92*a* and 92*b* relative to the floor surface.

In one embodiment, the bracket 82 freely rotates about the central axis 55 of the cleaning apparatus 30. In another embodiment the bracket rotates about the axis of the cleaning apparatus 30 and is fixed to the chassis 6 and moves with the movement of the chassis 6. Connection member 85 interconnects the fluid collection assembly 84 to the bracket assembly 82. In operation, as the direction of the cleaning machine 2 changes, for example, when making a left turn, the fluid collection assembly 84 may swing or move to the right relative to the central axis 55 to maintain control over the pool of cleaning fluid which, due to the momentum of the pool and the squeegee 92*a*, may tend to not follow the path of the cleaning machine and may tend to move to the right (relative to the central axis 55). Thus, the direction of travel of the cleaning machine 2 according to this embodiment does not cause cleaning fluid on the floor surface to avoid being collected and controlled by the squeegee 92*a*. As the fluid collection assembly 84 pivots to complement the path of travel of the cleaning machine 2, the motion of the cleaning machine 2 actually facilitates the puddling and the collection by the squeegee 92*a*, which blocks the cleaning fluid and carries the cleaning fluid while the cleaning machine 2 is in motion.

Figure 4:
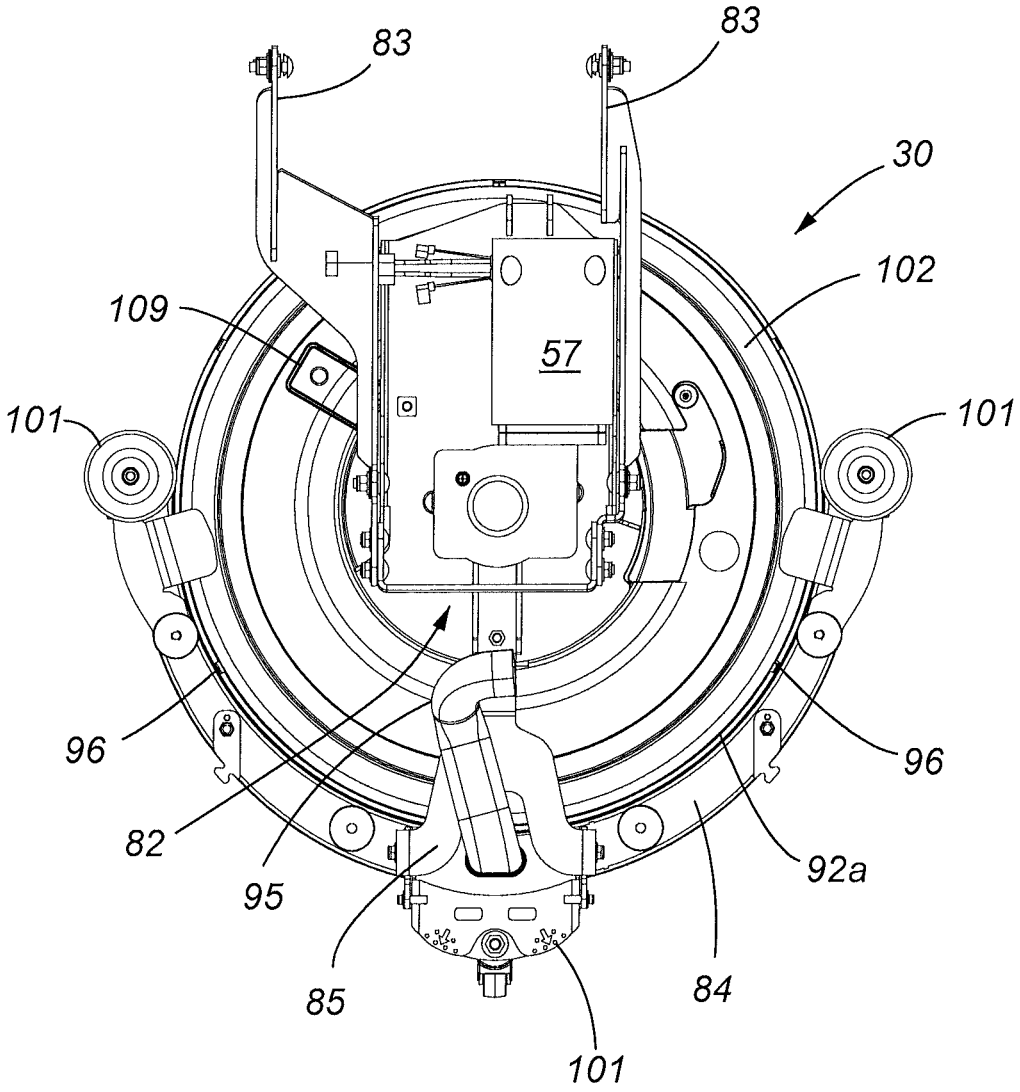
FIG. 4 is a top plan view of the cleaning apparatus and fluid collection assembly according to one embodiment.

Referring now to FIG. 4, one embodiment of the fluid collection assembly 84 is shown in a top plan view, rigidly coupled with the cleaning apparatus 30 by way of the bracket assembly 82. As can be seen in FIG. 4, the fluid collection assembly 84 is contoured and positioned to maintain a close spatial relationship with the outer circumference of the brush 102, and is fixedly secured to the cleaning apparatus 30 by the bracket assembly 82. According to the embodiment shown in FIG. 4, as the direction of the cleaning machine 2 changes, the plurality of arms 83, which are coupled to the chassis 6, change direction, which in turn cause the opposite change in direction of the bracket assembly 82. U.S. Pat. No. 7,533,435, which is incorporated by reference herein in its entirety, discloses another embodiment, whereby the fluid collection assembly is connected to a swing arm that may pivot about a point adjacent to the front wheel of the floor cleaning machine. According to this embodiment, the fluid collection assembly is supported via rollers located proximate to the each distal end of the squeegees, which maintain the squeegees position relative to the floor. Upon making a right or left hand turn, the fluid collection assembly will follow path of the vehicle (for example, as shown in FIGS. 12A-12D of U.S. Pat. No. 7,533,435). One skilled in the art will appreciate other methods of directing the path of travel of the fluid collection assembly relative to the floor cleaning machine may be utilized without departing from the scope of the invention. More specifically, a motorized system may be employed that is in communication with the steering system of the floor cleaning machine such that rotation of the steering wheel will swing the fluid collection assembly away from the floor cleaning machine in a predetermined manner.

In addition to the rollers described above, side rollers may be provided that prevent the fluid collection assembly from contacting a vertical surface, such as a wall. These wheels and various portions of the fluid collection assembly may be selectively adjustable such that the orientation of the fluid collection assembly, the height and width of the squeegees, etc., may be altered by the user.

Referring again to FIG. 4, the arrangement of the bracket assembly 82 and the plurality of arms 83 causes the fluid collection assembly 84 to rotate radially about the center axis 55 of the cleaning apparatus 30 such that the fluid collection assembly 84 is generally oriented in the opposite direction of the path of travel. The configuration also permits cleaning fluid to be collected and carried by the squeegees 92*a* as the machine changes direction, without significant loss of cleaning fluid caused by sudden changes of direction or rotation of the cleaning machine 2. Also shown in FIG. 4, the cleaning apparatus 30 further comprises at least one dispensing apparatus, such as a valve 109, for dispensing cleaning fluid from the clean fluid holding tank 62 to the brush 102. Valve 109 may further comprise one or more solenoids (not shown) for controlling the flow from the clean fluid holding tank 62. The valve 109 is preferably located to dispense cleaning fluid on the leading portion (towards the front of cleaning machine) of the brush 102. Those of ordinary skill in the art will appreciate that the valve(s) 109 may be located at different or additional locations along the surface of brush 102 of scrubbing assembly 54 without deviating from the novel aspects of the present disclosure.

Figure 5:
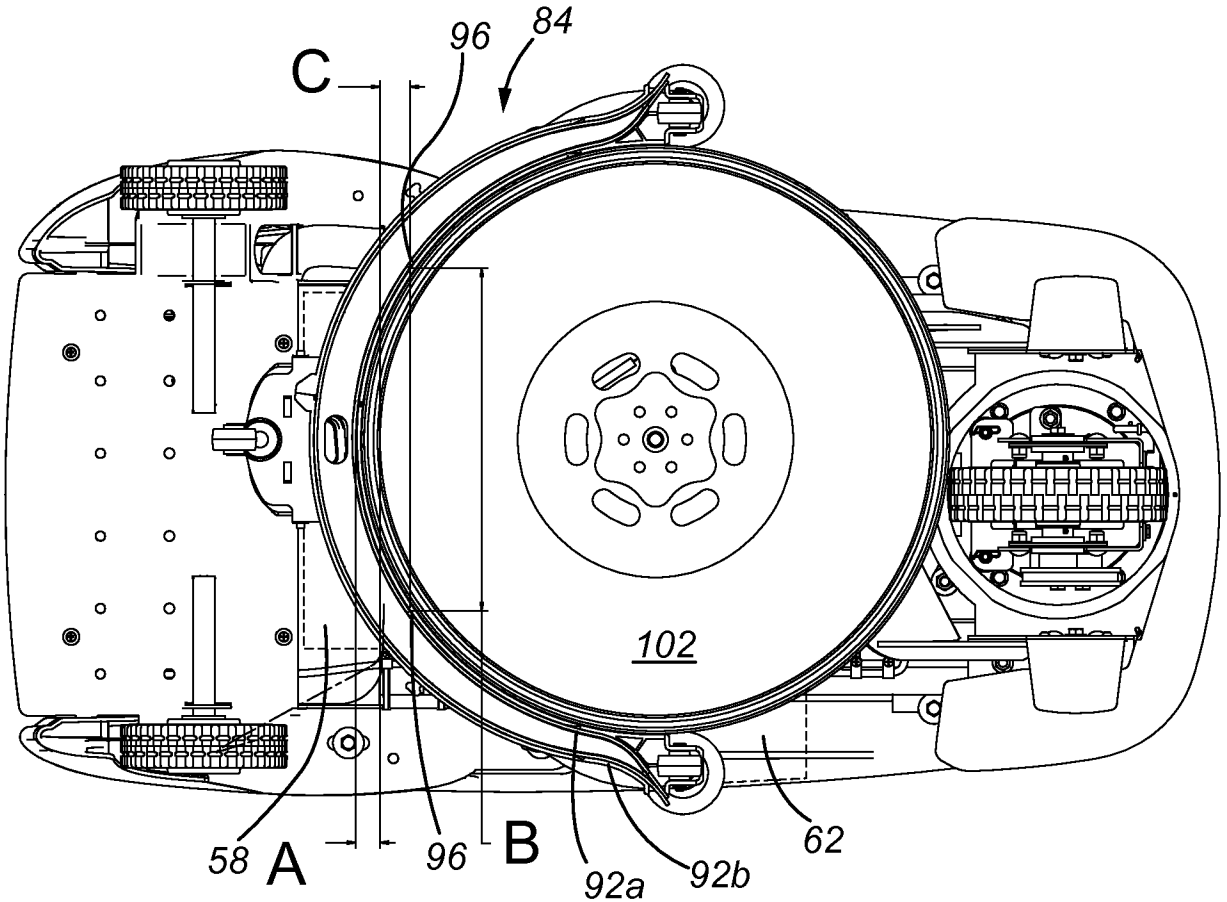
FIG. 5 is a bottom plan view of the cleaning machine according to one embodiment with the fluid collection assembly in a first position.

Referring now to FIG. 5, a bottom plan view of one embodiment of the cleaning machine 2, brush 102, and fluid collection assembly 84 is shown. Here the fluid collection assembly 84 is shown in a first position or configuration, whereby the spacing between the squeegee 92*a* of the fluid collection assembly 84 and the outer circumference of the brush 102 of the cleaning apparatus 30 is approximately 0.25 inches (noted as dimension A in FIG. 5). Dimension A is preferably in the range of 0.10-2.0 inches, and most preferably is in the range of 0.25-1.0 inches.

Also shown in FIG. 5, and according to a preferred embodiments, the linear distance between apertures 96 is about 12.58 inches (noted as dimension B in FIG. 5). This spacing (with the circular brush configuration having a diameter of 20 inches shown in FIG. 5) has been found to provide sufficient pooling of the cleaning fluid to provide a sufficient volume of cleaning fluid at a desirable location relative to the position of the brush such that the brush rotates through the pool of cleaning fluid to continuously lubricate the brush with cleaning fluid and recirculate the cleaning fluid, without any undesired loss of fluid, and at an overall increase in cycle-time of the floor cleaning machine.

By collecting and recirculating the cleaning fluid, the apparatus avoids unnecessary over-dispensing of cleaning fluid (beyond the amount required to lubricate the brush 102 and clean the floor surface). As the apertures 96 are spaced closer together, the size of the pool of cleaning fluid created by the squeegee 92*a* decreases, and likewise as the apertures are spaced farther apart the size of the pool increases. However, the spacing of apertures at about 12.58 inches for the arcuate squeegee shown in FIG. 5 has been found to be the preferred spacing of apertures 96 to create a sufficient pool or puddle of cleaning fluid to lubricate the brush without causing unnecessary waste of cleaning fluid.

Excess fluid deposited on the floor surface will cause the puddle to increase, up to the point when the fluid reaches the apertures 96 and is carried by the vacuum pressure through the vacuum tube 95 to the spent fluid holding tank 58. Sensors (not shown) may be incorporated with varying embodiments described herein for detecting the rate of fluid deposited in the spent fluid holding tank 58 and relayed to the fluid dispensing apparatus, should excess fluid be deposited. However, it is an object of at least some embodiments of the present disclosure to avoid waste of cleaning fluid and to optimize the use of the cleaning fluid.

Figure 6:
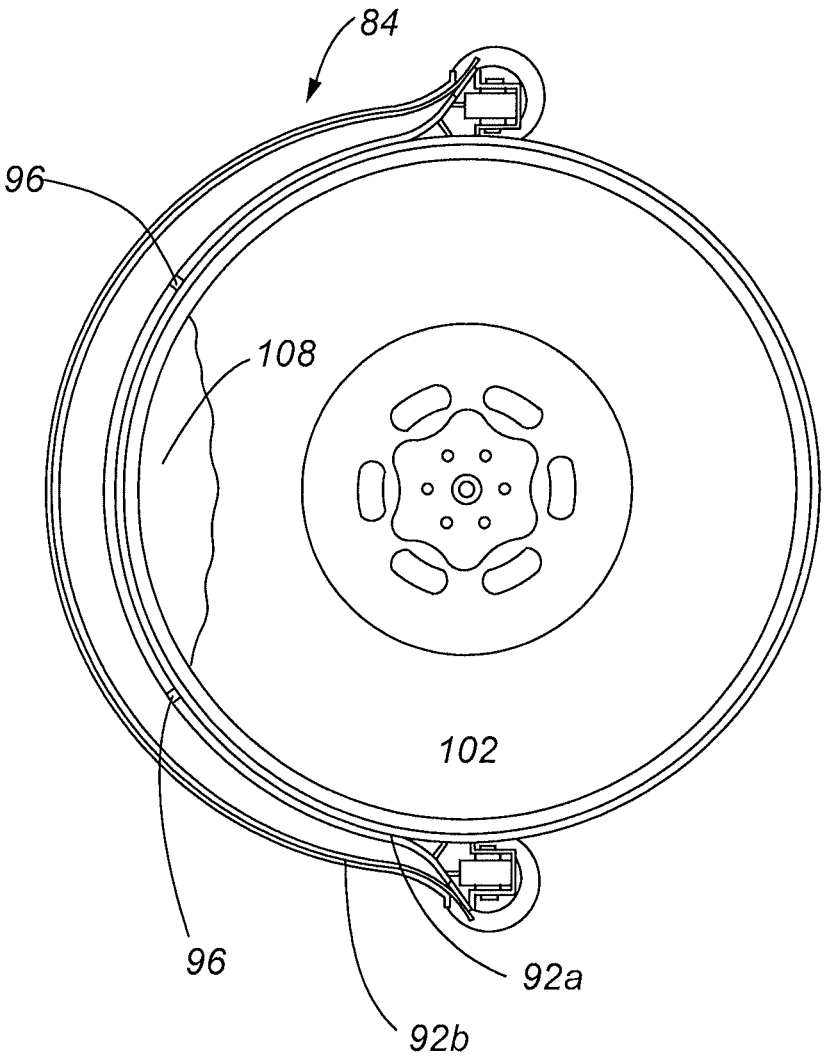
FIG. 6 is a bottom plan view of the cleaning apparatus and fluid collection assembly depicting a cleaning fluid puddle.

FIG. 6 is a partial bottom plan view of the cleaning apparatus 30 and the fluid collection assembly 84 shown in FIG. 5. The approximate location of the pooled or puddled cleaning fluid is show in FIG. 6 by a wavy line, which is referred to hereafter as the retention area 108. The spacing of the fluid collection assembly 84 relative to the brush 102, the position and size of the apertures 96 and the strength of the vacuum are factors which contribute to defining the size of the retention area. On the leading side (leading side is defined by the front wheel 14), the spacing of the apertures 96 permits cleaning fluid to collect against the squeegee 92 and pool in an area where the brush 102 rotates. The retention area 108 is defined on the trailing edge by the arcuate shape of the squeegee 92*a*.

According, the brush 102 is continuously exposed to the retention area 108 (due to its rotation) without the need for continuous or near-continuous dispensing of cleaning fluids. Thus, the retention area 108 causes the brush 102 to remain lubricated with cleaning fluid as it rotates through the area where the brush is in contact with the pooled cleaning fluid. The cleaning fluid is pooled so that substantially all of the cleaning fluid dispensed is in contact with the portion of the brush that is in contact with the floor surface, and the brush remains lubricated throughout the cleaning cycle. In this configuration, with the spacing between squeegee 92*a* and the brush 102 being about 0.25 inches, the brush is in contact with the retention area 108 in a dimension of about 1.25 inches (shown in FIG. 5 as dimension C), so that about 1.25 inches of the width of the brush comes into contact with the retention area 108. According to various embodiments, the brush 102 overlaps the retention area by about 10-20% of the total surface area of the brush 102.

Although the brush 102 does not completely overlap the retention area 108 during its rotation, this does not mean that the brush 102 is not lubricated throughout the areas of the brush that do not overlap the retention area 108. This is because, as the cleaning machine 2 is in motion, the brush 102 at least partially passes through the retention area 108, thereby lubricating that portion of the brush 102. As the brush 102 rotates, the area of the brush 102 that has passed through the retention area 108 rotates to the front of the cleaning machine 2, and in doing so dispenses some of the fluid collected from the retention area 108 on to the floor surface. During this rotation of the brush 102, the cleaning machine 2 is in motion, and moving in a general forward direction (towards the front wheel). This causes the portions of the brush 102 that have not passed through the retention area 108 to pass over the areas of the floor surface where the brush 102 (the potion that has passed through the retention area and has been lubricated) to become lubricated from the cleaning fluid on the floor surface. Thus, the combination of the rotation of the brush, the lubrication of the floor surface by the portion of the brush 102 that has passed through the retention area 108, the motion of the cleaning machine 2, and the movement of the portions of the brush 102 that have not passed through the retention area 108 over the now lubricated floor surface combined to lubricate an effective portion of the brush 102 during a typical cleaning cycle.

Figure 7:
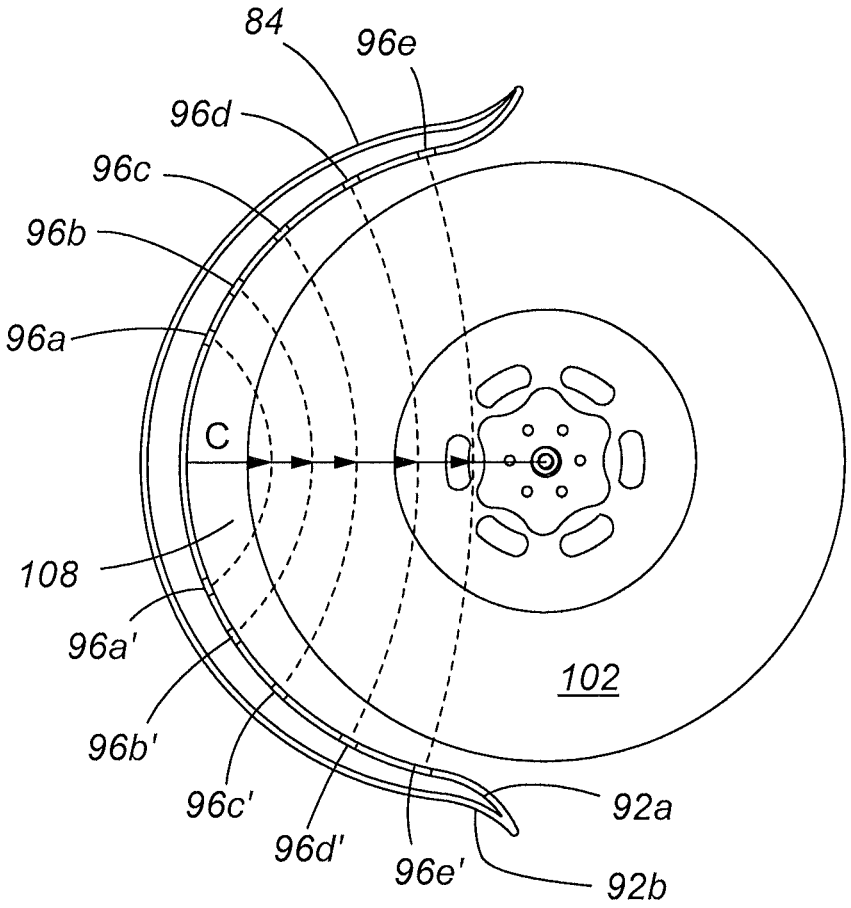
FIG. 7 is a bottom plan view of the cleaning apparatus according to one embodiment with the fluid collection assembly in a second position and further depicting alternate cleaning fluid puddles.

Referring now to FIG. 7, the cleaning machine 2, brush 102 and fluid collection assembly 84 are shown in a second configuration. Here, the fluid collection assembly 84 comprises leading squeegee 92*a* at about 2 inches from the outer circumference of the brush 102 of the cleaning apparatus 30. In this configuration, the brush is in contact with the retention area 108 in a dimension of about 0.9 inches (shown in FIG. 7 as dimension C), so that about 0.9 inches of the width of the brush comes into contact with the retention area 108. According to one preferred embodiment, the amount of overlap between the brush 102 and the retention area 108 is about 0.5 and 3 inches. In a more preferred embodiment, the range of overlap is between 0.7 and 2.25 inches. According to the most preferred embodiment, about 0.9-1.25 inches of overlap between the brush 102 and the retention area 108 is preferred for most common size brushes for cleaning machines (these currently being 20 inches, 16 inches, 13 inches and 12 inches in diameter). If less then these ranges are provided, the brush is not lubricated enough. If too much is provided, the capacity of the cleaning fluid is diminished. The following examples also describe this optimal range.

Referring still to FIG. 7, a top plan view of the fluid collection assembly 84 and cleaning apparatus is shown. In FIG. 7, the optimal location of the apertures 96 of squeegee 92*a* are shown (96*b* and 96*b*'), with a dashed line marking the approximate boundary of the pooling created during operation of the cleaning machine. However, if the apertures are positioned farther apart (96*c* and 96*c*' through 96*e* and 96*e*'), the boundary of the retention area 108 becomes larger. If the apertures are positioned closer together (96*a* and 96*a*'), the retention area becomes smaller.

The optimal location for apertures 96 is due to the combination of two variables: (1) the amount of brush 108 surface area that may come into contact with the pooling area and remain suitably lubricated; and (2) the capacity of the cleaning fluid (i.e., how little cleaning fluid may be used to maintain the brush 108 in a lubricated state). By placing the apertures in the preferred location shown in FIG. 7 (96*b* and 96*b*'), a sufficiently large retention area 108 is created to maintain the brush 102 in a lubricated state, but not so large that additional cleaning fluid must be used to maintain the volume of cleaning fluid in the retention area 108. In addition, as the apertures 96 are moved farther apart, the retention area soon overlaps areas of the brush 108 that do not have bristles (i.e., the retention area relative to the position of apertures 96*d* and 96*d*' and 96*e* and 96*e*'), thereby reducing the net effect of pooled cleaning fluid and usable retention area 108.

Figure 8:
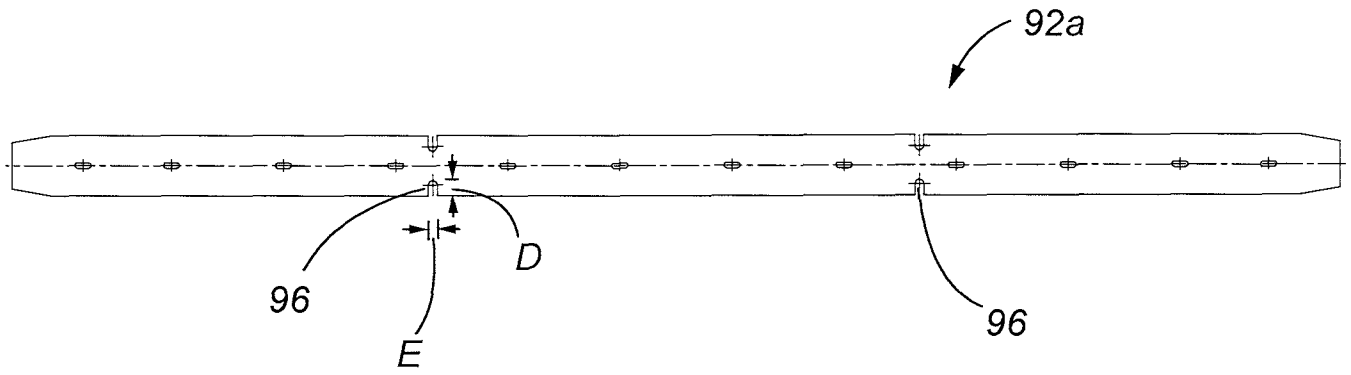
FIG. 8 is a elevation view of the squeegee according to one embodiment.

According to varying embodiments described herein, the location and size of the apertures 96 has been determined to influence the performance of the cleaning machine 2. In particular, smaller apertures 96 than those described herein tend to cause the squeegee 92*a* to vibrate against the floor surface, causing loss of cleaning fluid and thereby decreasing the size of the retention area 108. Referring now in detail to FIG. 8, a plan view of leading squeegee 92*a* and apertures 96 is shown. It is to be understood that FIG. 8 represents a view of the squeegee 92*a* as it is laid on planner surface, and therefore FIG. 8 does not depict the arcuate or radial curvature of squeegee 92*a* when it is coupled with fluid collection assembly 84. According to a preferred embodiment, the squeegee is made from a natural gum rubber having about 0.125 inches in thickness.

The apertures 96 of squeegee 92*a* are approximately 7/16 inches tall and approximately ¼ inches wide. It is to be expressly understood that the size of the apertures 96 may vary from these stated dimensions as the size of the brush 102, retention area 108, and the squeegee 92*a* are varied. Generally, increasing the size of the apertures 96 causes a greater amount of cleaning fluid to be drawn through the apertures 96 and also decreases the size of the retention area 108. Decreasing the size of the apertures 96 generally causes squeegee 92*a* to vibrate, and in turn causes the squeegee 92*a* to flex, permitting some cleaning fluid to pass beneath the squeegee 92*a*.

Thus, in operation, the efficiency of the cleaning machine 2 is improved by pooling cleaning fluid in front of the leading squeegee 92*a*, and using that fluid as a source of cleaning fluid for the brush 102 to remain lubricated for cleaning the floor surface. The combination of the shape of the squeegee 92*a*, its position relative to the brush 102, strategically placed apertures 96 and the force of the associated vacuum pressure all factor into controlled pooling of the cleaning fluid, which combine to permit a greater amount of floor surface to be cleaned given a fixed volume of cleaning fluid. This combination in turn provides a more efficient use of the cleaning fluid and maximizes the time the cleaning machine 2 may be continuously operated without stopping to refill the clean fluid or remove the spent fluid. It is expressly understood that efficiency, as used herein, is intended to mean greater floor coverage during a cleaning cycle for a cleaning machine, without increasing the capacity of the cleaning fluid holding tank (i.e., greater surface area may be cleaned with a fixed amount of cleaning fluid).

Example 1

The following tables are shown herein for reference.

| Double aperture squeegee | |
|---|---|
| Bucket + Water Weight | 2.54 lb |
| Bucket Weight | 1.32 lb |
| Net Water Weight | 1.22 lb |
| Calculated GPM | 0.29 gal/min |

| Triple aperture squeegee | |
|---|---|
| Bucket + Water Weight | 4.16 lb |
| Bucket Weight | 1.32 lb |
| Net Water Weight | 2.84 lb |
| Calculated GPM | 0.68 gal/min |

The preceding tables of Example 1 reflect the decrease in cleaning fluid gallons per minute ("GPM") for the squeegee having apertures spaced at about 12.58 inches, as is the case in a preferred embodiment, compared to a squeegee having an additional aperture at the mid-point of the squeegee. As shown in the tables above, the cleaning fluid dispensing rate was reduced from 0.68 to 0.29 gallons per minute by including the two apertures at the locations specified above, which amounts to almost a 60% reduction in the flow rate for the cleaning solution. Whereas the three aperture squeegee picks up dispensed fluid almost immediately, the two aperture squeegee of a preferred embodiment allows the cleaning fluid to puddle and maintains the desired lubrication level of the brush, but without loss of cleaning fluid in to the floor surface fibers. Thus, a method for extending the cleaning cycle of a cleaning machine which incorporates the novel features described herein is also contemplated as part of the present disclosure.

It is further believed that the longer use of the cleaning fluid entrains more dirt thereby enhancing the cleaning efficiency of the cleaning fluid. In one embodiment, the prolonged use of cleaning fluid provides for improved entraining of dirt on the floor surface while the cleaning machine is in operation.

While various embodiments of the present disclosure have been described in detail, it is apparent that modifications and alterations of those embodiments will occur to those skilled in the art. However, it is to be expressly understood that such modifications and alterations are within the scope and spirit of the present disclosure.

What is claimed:

1. A floor cleaning machine, comprising:

a chassis that is supported by a plurality of wheels;

at least one vessel for holding unused cleaning fluids and at least one vessel for holding spent cleaning fluids;

at least one dispensing apparatus for dispensing unused cleaning fluid;

at least one vacuum apparatus for retrieving spent cleaning fluids; and a floor cleaning apparatus comprising:

a substantially circular brush rotatable about a substantially vertical axis wherein the machine is devoid of any other brush;

a first squeegee spaced about 0.2 to 1.0 inches from said substantially circular brush and having a generally arcuate shape which substantially conforms to an outer contour of said brush along approximately 180° of the circumference of said brush, said first squeegee comprising a plurality of apertures on a bottom edge of said first squeegee;

a second squeegee having a generally arcuate shape and positioned on the opposite side of said first squeegee as said brush;

wherein said first squeegee is positioned substantially flush to a floor surface to permit a pooling area of cleaning fluid thereon, said cleaning fluid at least partially overlapping the area of the floor surface in contact with said brush, so that at least a portion of said brush may continually pass through said pooling area, wherein said plurality of apertures in said first squeegee are positioned a distance away from each other to permit fluid to exit said pooling area by passing through said plurality of apertures;

wherein at least two apertures are in fluid communication with said at least one vacuum apparatus and are spaced a distance apart from a mid-point of the first squeegee such that said mid-point of said first squeegee is devoid of apertures such that said pooling area of cleaning fluid is provided at least partially between said at least two apertures, and said pooling area maintains said brush in a substantially lubricated state wherein a fluid flow rate through said first squeegee is less than approximately 0.50 gallons per minute.

2. The floor cleaning machine according to claim 1 wherein said plurality of apertures are comprised of two apertures spaced about 12.58 inches linearly from each other, and each of said two apertures is equidistant from a midpoint of said first squeegee.

3. The floor cleaning machine according to claim 1 wherein said first and second squeegees are rotatable about said brush as the floor cleaning machine changes direction and maintains said pooling area against said first squeegee when the floor cleaning machine changes direction.

4. The floor cleaning machine according to claim 1 wherein said second squeegee is spaced a greater distance from said brush than said first squeegee and is devoid of apertures.

5. The floor cleaning machine according to claim 1 wherein said first squeegee is spaced about 0.25 inches from said outer contour of said brush.

6. The floor cleaning machine according to claim 1 wherein each of said plurality of apertures comprise a height extending from said bottom edge of said first squeegee by about 7/16 inches and are about ¼ inches wide.

7. A floor cleaning machine, comprising:

a chassis connected to a plurality of wheels that supports at least one vessel for holding unused cleaning fluids and at least one vessel for holding spent cleaning fluids;

a substantially circular brush rotatable about a vertical axis, and wherein the machine is devoid of any other brush;

a leading squeegee proximate to said brush and having a generally arcuate shape which substantially conforms to an outer contour of said brush along approximately 180° of the circumference of said brush, said leading squeegee having two apertures, each positioned a distance away from a radial midpoint of said leading squeegee to permit fluid to pass therethrough and said leading squeegee spaced about 0.2 to 1.0 inches from said outer contour of said brush; and a trailing squeegee positioned adjacent said leading squeegee and on the opposite side of said leading squeegee as said brush;

wherein the leading squeegee and the trailing squeegee are allowed to pivot about a central axis and thereby prevent pooled cleaning fluid from being carried away from said squeegees;

wherein, when said leading squeegee is positioned substantially flush to a floor surface and cleaning fluid is dispensed by the floor cleaning machine, an area of cleaning fluid becomes retained against said leading squeegee between said two apertures to effect a pooling of cleaning fluid on a floor surface at least partially overlapping an area in contact with the brush so that the brush may continually pass through the pooling area and clean the floor surface, said retained cleaning fluid at least partially overlapping said brush so that at least a portion of said brush passes through said retained cleaning fluid during rotation of said brush; and wherein a first aperture and a second aperture are spaced a linear distance apart from a mid-point of the leading squeegee by at least about 6 inches from the mid-point such that the mid-point is devoid of apertures and such that a continuous central portion of the leading squeegee is provided, wherein said pooling area of cleaning fluid is provided at least partially between the apertures and said pooling area maintains said brush in a substantially lubricated state; and wherein a fluid flow rate through said leading squeegee is less than approximately 0.50 gallons per minute.

8. The floor cleaning machine according to claim 7 wherein said two apertures are spaced linearly about 12.58 inches from each other, each of said two apertures being equidistant from said radial midpoint of said leading squeegee.

9. The floor cleaning machine according to claim 8 wherein said two apertures are in fluid communication with at least one vacuum apparatus for removing cleaning fluid passing through said two apertures and for confining said retained cleaning fluid pooled against said leading squeegee between said two apertures.

10. The floor cleaning machine according to claim 9 wherein said trailing squeegee is spaced a greater distance from said brush than said leading squeegee and is substantially devoid of apertures to collect spent cleaning fluid to be retrieved by said vacuum apparatus.

11. The floor cleaning machine according to claim 10 wherein said at least one vacuum apparatus provides vacuum pressure via a hose or tube.

12. The floor cleaning machine according to claim 7 wherein said leading squeegee is spaced about 0.25 inches from said outer contour of said brush.

13. The floor cleaning machine according to claim 7 wherein said two apertures comprise a height extending from a bottom edge of said leading squeegee by about 7/16 inches and are about 1/4 inches wide.

14. The floor cleaning machine according to claim 7 wherein said leading and trailing squeegees are rotatable about said brush as the floor cleaning machine changes direction and maintains the cleaning fluid against said leading squeegee when the floor cleaning machine changes direction.

* * * * *